US006474403B1

(12) United States Patent
Nikolovski et al.

(10) Patent No.: US 6,474,403 B1
(45) Date of Patent: Nov. 5, 2002

(54) CASTING METAL STRIP

(75) Inventors: Nikolco S. Nikolovski, Figtree; Peter A Woodberry, Austinmer; Brett Gray, Mangerton, all of (AU)

(73) Assignee: Castrip, LLC, Charlotte, NC (US)

( * ) Notice: Subject to any disclaimer, the term of this patent is extended or adjusted under 35 U.S.C. 154(b) by 0 days.

(21) Appl. No.: 09/495,697

(22) Filed: Feb. 1, 2000

(30) Foreign Application Priority Data

Feb. 5, 1999 (AU) ..... PP8524

(51) Int. Cl.[7] ..... B22D 11/06; B22D 11/16
(52) U.S. Cl. ..... 164/452; 164/480
(58) Field of Search ..... 164/428, 480, 164/452, 154.5

(56) References Cited

U.S. PATENT DOCUMENTS 5,031,688 A 7/1991 Burgo et al.
5,184,668 A 2/1993 Fukase et al.
5,191,927 A 3/1993 Terado et al.
5,706,882 A 1/1998 Fellus et al.

FOREIGN PATENT DOCUMENTS

JP 60-83746 * 5/1985
JP 1-154850 * 6/1989

OTHER PUBLICATIONS

Patent Abstract of Japan, vol. 1995, No. 05, Jun. 30, 1995 and JP 07 040008 a (Nippon Steel Corp.) Feb. 10, 1995.

* cited by examiner

*Primary Examiner*—Kuang Y. Lin
(74) *Attorney, Agent, or Firm*—Barnes & Thornburg

(57) ABSTRACT

Twin roll casting of metal strip (20) by rotation of parallel casting rolls (16) supplied with molten metal through distributor (19*a*) and delivery nozzle (19*b*). X-ray scanner (44) continuously scans the thickness of strip (20) to produce a signal which is a continuous measure of thickness variation along the strip due to eccentricities of the casting rolls (16). This signal controls operation of roll drive motors (53) to impose a pattern of speed variation on the rolls so as to reduce the amplitude of the thickness variations.

11 Claims, 3 Drawing Sheets

CASTING METAL STRIP

TECHNICAL FIELD

This invention relates to the casting of metal strip. It has particular but not exclusive application to the casting of ferrous metal strip.

It is known to cast metal strip by continuous casting in a twin roll caster. Molten metal is introduced between a pair of contra-rotated horizontal casting rolls which are cooled so that metal shells solidify on the moving roll surfaces and are brought together at the nip between them to produce a solidified strip product delivered downwardly from the nip between the rolls. The term "nip" is used herein to refer to the general region at which the rolls are closest together. The molten metal may be poured from a ladle into a smaller vessel or series of smaller vessels from which it flows through a metal delivery nozzle located above the nip so as to direct it into the nip between the rolls, so forming a casting pool of molten metal supported on the casting surfaces of the rolls immediately above the nip. This casting pool may be confined between end closure side plates or dams held in sliding engagement with the ends of the rolls.

In twin roll casting, eccentricities in the casting rolls can lead to strip thickness variations along the strip. Such eccentricities can arise either due to machining and assembly of the rolls or due to distortion when the rolls are hot possibly due to non-uniform heat flux distribution. Specifically, each revolution of the casting rolls will produce a pattern of thickness variations dependent on eccentricities in the rolls and this pattern will be repeated for each revolution of the casting rolls. Usually the repeating pattern will be generally sinusoidal, but there may be secondary or subsidiary fluctuations within the generally sinusoidal pattern. By the present invention these repeated thickness variations can be very much reduced by imposing a pattern of speed variations in the speed of rotation of the rolls. Compensation in this manner is possible because even small speed variations vary the time of contact of the solidifying metal shells on the rolls within the casting pool and therefore the thickness of the shells which are brought together at the nip. It is thus possible to compensate for an increase in the nip tending to produce a thickening of the strip by an instantaneous acceleration of the rolls so as to decrease the time for shell solidification thereby to produce a compensating tendency for thinning of the strip. Furthermore, varying solidification time will result in varying casting roll temperature distribution which will result in roll shape change and when appropriately matched with initial roll eccentricity will compensate for it.

DISCLOSURE OF THE INVENTION

According to the invention there is provided a method of casting metal strip comprising introducing molten metal between a pair of chilled casting rolls forming a nip between them to form a casting pool of molten metal supported on the rolls and confined at the ends of the nip by pool confining end closures, rotating the rolls so as to cast a solidified strip delivered downwardly from the nip, transporting the strip away from the nip, inspecting the strip as it is transported away from the nip to determine a pattern of thickness variations along the strip due to eccentricities of the casting roll surfaces, and imposing a pattern of speed variation on the rotation of the casting rolls determined by said pattern of thickness variations so as to reduce the amplitude of the thickness variations.

Said pattern of thickness variations may be a regularly repeating pattern.

Preferably, the strip is inspected by an inspection means which produces signals indicative of the frequency and amplitude of repeating thickness variations and the speed of the casting rolls is varied in accordance with those signals.

The pattern of imposed speed variations may comprise a single variation for each revolution of the casting rolls. Alternatively, there may be more than one variation for each revolution of the casting rolls.

Preferably, the rolls are rotated by electric drive motor means and the pattern of imposed speed variations is imposed by feeding said signals directly to the drive motor means.

The imposed speed variation may be applied at an initial timing phase relative to the rotation of the rolls and the phase then varied to minimise the amplitude of the thickness variations.

The method of the invention may also include the step of varying the average speed of rotation of the rolls throughout the cast to maintain a constant average thickness of the strip.

The invention further provides apparatus for casting metal strip comprising

- a pair of parallel casting rolls forming a nip between them;
- a metal delivery system for delivering molten metal into the nip to form a casting pool of molten metal supported above the nip;
- a pair of pool confining end closures disposed one at each end of the pair of casting rolls;
- roll drive means to rotate the rolls in opposite directions to deliver a cast strip downwardly from the nip;
- strip transport means to transport the strip away from the nip;
- strip inspection means to inspect the strip as it is transported away from the nip to determine a pattern of thickness variations along the strip due to eccentricities of the casting roll surfaces; and
- control means to impose a pattern of speed variations on the rotation of the casting rolls determined by said pattern of thickness variations so as to reduce the amplitude of the thickness variations.

Preferably, the inspection means is operable to generate signals indicative of the frequency and amplitude of the thickness variations and the control means is effective to control operation of the roll drive means in response to those signals.

Preferably, the roll drive means comprises electric motor means and the control means is effective to feed said signals to the electric motor means.

BRIEF DESCRIPTION OF THE DRAWINGS

In order that the invention may be more fully explained one particular embodiment will be described in detail with reference to the accompanying drawings in which.

DETAILED DESCRIPTION OF THE PREFERRED EMBODIMENT

Figure 1:
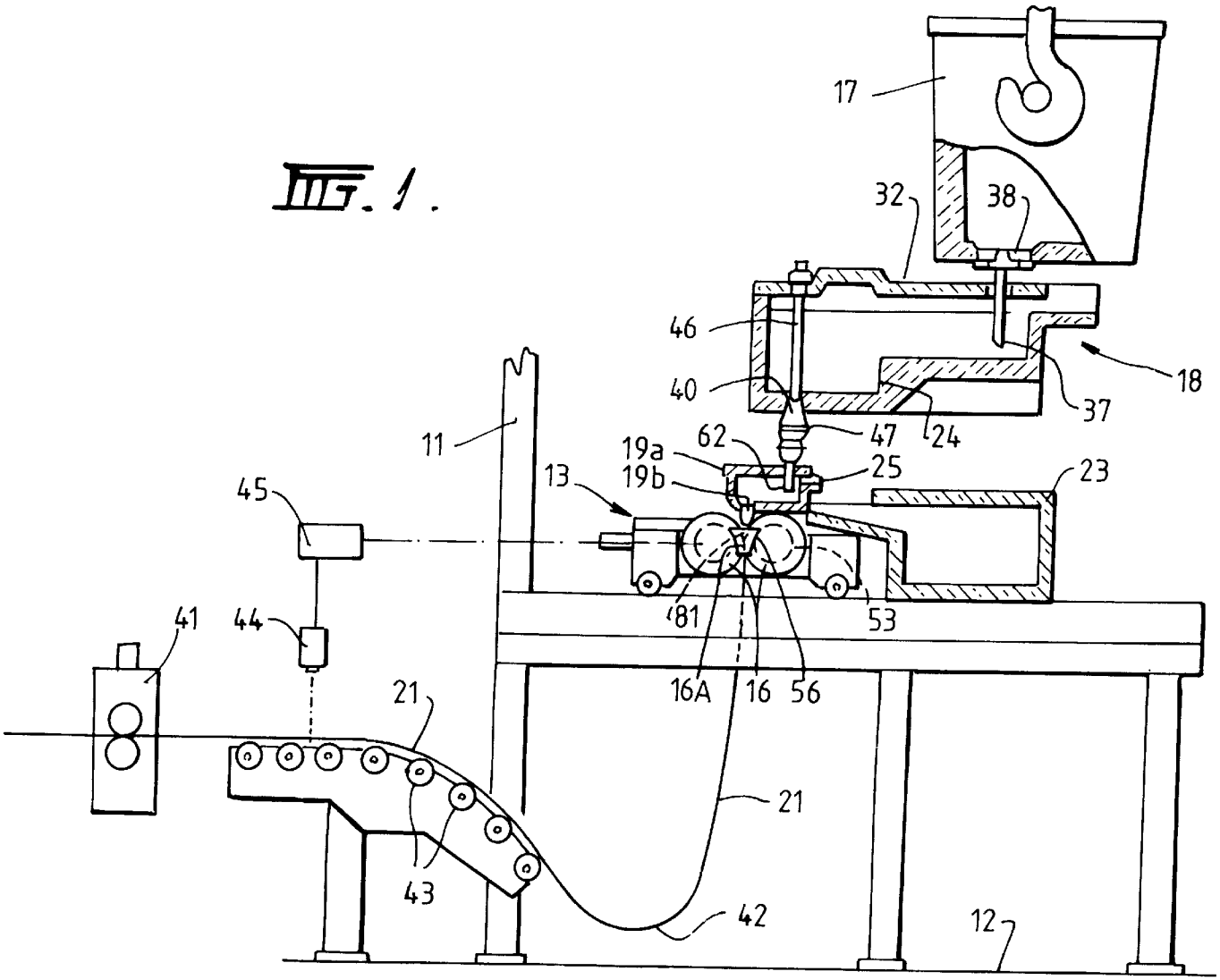
FIG. 1 illustrates a continuous strip caster suitable for operation in accordance with the present invention.

The illustrated caster comprises a main machine frame, generally identified by the numeral 11, which stands up from the factory floor 12. Frame 11 supports a casting roll carriage 13 which is horizontally movable between an assembly station and casting station. Carriage 13 carries a pair of parallel casting rolls 16 which form a nip (16A) in which a casting pool of molten metal is formed and retained between two side plates or dams 56 held in sliding engagement with the ends of the rolls.

Molten metal is supplied during a casting operation from a ladle 17 via a tundish 18, delivery distributor 19*a* and nozzle 19*b* into the casting pool. Before assembly above the carriage 13, tundish 18, distributor 19*a*, nozzle 19*b* and the side plates are all preheated to temperatures in excess of 1000° C. in appropriate preheat furnaces (not shown). The manner in which these components may be preheated and moved into assembly above the carriage 13 is more fully disclosed in U.S. Pat. No. 5,184,668.

Casting rolls 16 are contra-rotated through drive shafts 51 by electric motors 53. Rolls 16 have copper peripheral walls formed with a series of longitudinally extending and circumferentially spaced water cooling passages supplied with cooling water through the roll ends from water supply ducts in the roll drive shafts 51 which are connected to water supply hoses 52 through rotary glands 54. The roll may typically be about 500 mm diameter and up to 2000 mm long in order to produce strip product approximately the width of the rolls.

Pool confinement plates 56 are held against stepped ends 57 of the rolls 16. Plates 56 are made of a strong refractory material, for example boron nitride, and have scalloped side edges to match the curvature of the stepped ends of the rolls. They can be mounted in plate holders 58 which are movable by actuation of a pair of hydraulic cylinder units 59 to bring the side plates into engagement with the stepped ends of the casting rolls to form end closures for the molten pool of metal formed on the casting rolls during a casting operation.

During a casting operation metal from the casting pool solidifies as shells on the moving roll surfaces and the shells are brought together at the nip between them to produce a solidified strip product 20 at the roll outlet. This product is fed across a guide table 21 to a pinch roll stand 41 which transports the strip to a standard coiler.

The strip 20 hangs in a loop 42 beneath the caster before it passes to the guide table 21. The guide table comprises a series of strip support rolls 43 to support the strip before it passes to the pinch roll stand 41. Rolls 43 are disposed in an array which extends back from the pinch roll stand 41 toward the caster and curves downwardly at its end remote from the pinch rolls so as to smoothly receive and transport the strip from the loop 42. A receptacle 23 is mounted on the machine frame adjacent the casting station and molten metal can be diverted into this receptacle via an overflow spout 25 on the distributor 19*a* if there is a severe malfunction during a casting operation.

Figure 2:
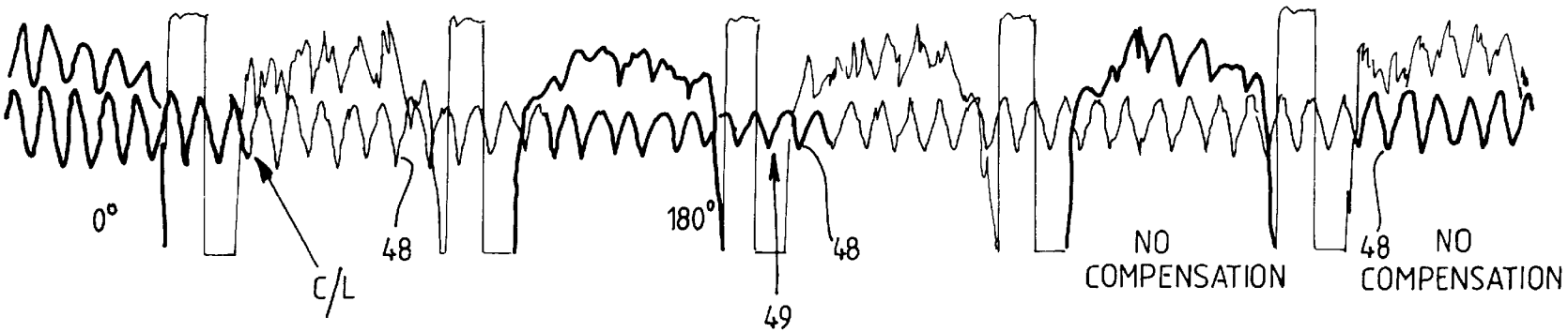
FIG. 2 shows a plot of reference signals and actual strip thickness measurements during a casting run in a strip caster of the kind illustrated by FIG. 1.
Figure 3:
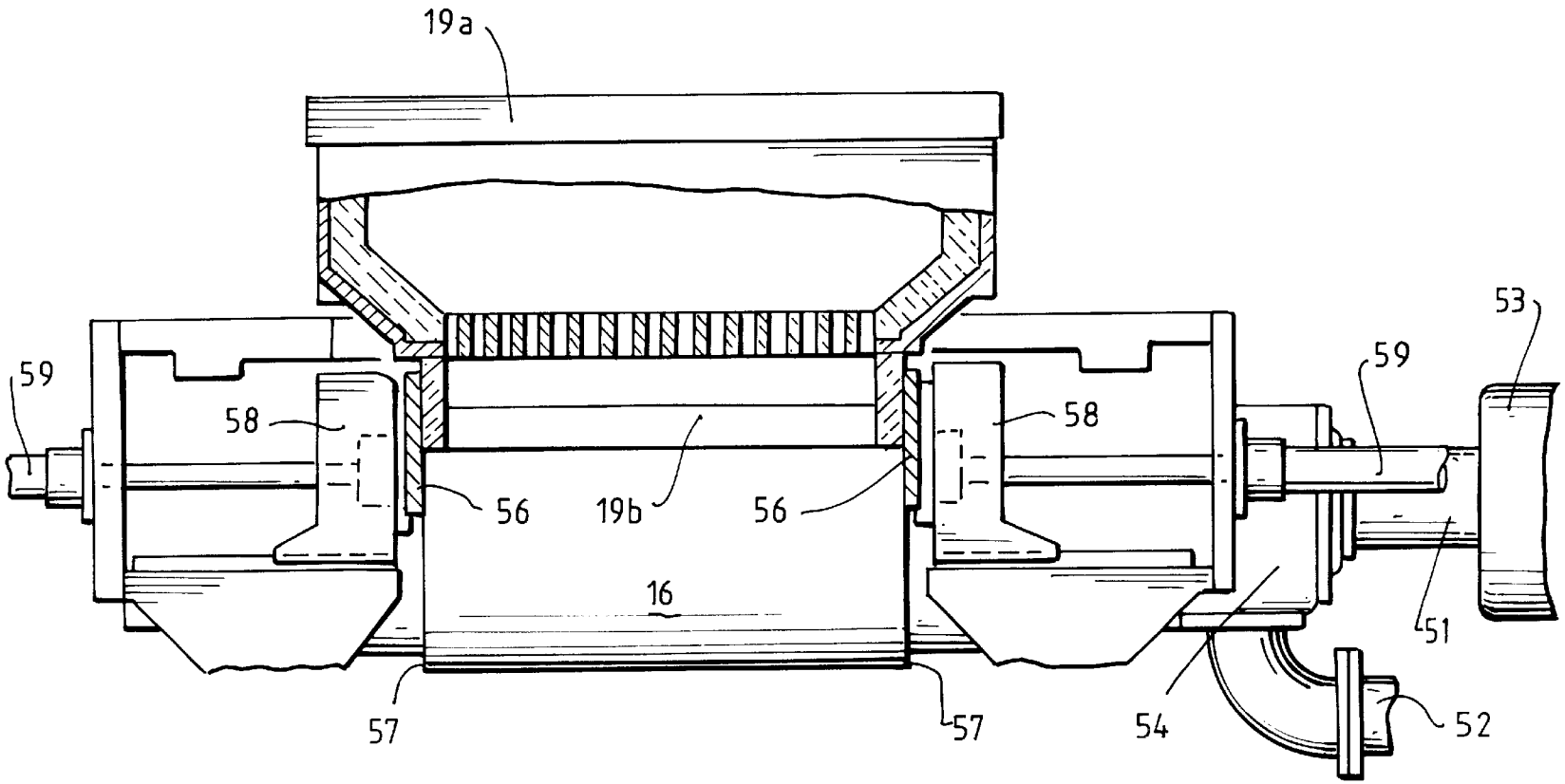
FIG. 3 is a vertical cross-section through essential components of the caster.

Tundish 18 is fitted with a lid 32 and its floor is stepped at 24 so as to form a recess or well 26 in the bottom of the tundish at its left-hand and as seen in FIG. 2. Molten metal is introduced into the right-hand end of the tundish from the ladle 17 via an outlet nozzle 37 and slide gate valve 38. At the bottom of well 26, there is an outlet 40 in the floor of the tundish to allow molten metal to flow from the tundish via an outlet nozzle 62 to the delivery distributor 19*a* and the nozzle 19*b*. The tundish 18 is fitted with a stopper rod 46 and slide gate valve 47 to selectively open and close the outlet 40 and effectively control the flow of metal through the-outlet.

In operation of the illustrated apparatus, molten metal delivered from delivery nozzle 19*b* forms a pool 81 above the nip between the rollers, this pool being confined at the ends of the rollers by side closure plates 82 which are held against stepped ends of the rollers by actuation of a pair of hydraulic cylinder units. The upper surface of pool 81, generally referred to as the "meniscus level" rises above the lower end of the delivery nozzle. Accordingly, the lower end of the delivery nozzle is immersed within the casting pool and the nozzle outlet passage extends below the surface of the pool or meniscus level.

In accordance with the present invention the strip 20 on the guide table 21 passes under an X-ray scanner 44 which continuously scans the thickness of the strip along the centre line of the strip to produce a signal which is a continuous measure of thickness variations along the centre line. Because of inevitable eccentricities in the casting roll surfaces, the width of the nip between the rolls will vary during each revolution of the rolls to produce repeated thickness variations along the strip. The thickness variation will generally be sinusoidal and without compensation can be of quite wide amplitude. By the present invention, it is possible to compensate for the variations in nip width by imposing a pattern of speed variations in the speed of rotation of the rolls. This is possible because even small speed variations vary the time of contact of the solidifying metal shells on the rolls within the casting pool and therefore the thickness of the shells which are brought together at the nip. It is thus possible to compensate for an increase in the nip width tending to produce a thickening of the strip by acceleration of the rolls so as to decrease the time for shell solidification thereby to produce a compensating tendency for thinning of the strip.

In addition, varying the solidification time will result in varying heat transfer into the roll changing the temperature distribution in the casting rolls. Increasing the roll temperature locally causes expansion of that region resulting in the roll bending in a convex manner. By inducing the roll bending appreciably opposite to initial bending, substantial compensation may be made resulting in uniform width gap at the nip.

The signals generated by the X-ray scanner 44 are fed to a controller 45 to produce control signals which are fed directly to the electric motors 53 which drive the casting rolls. Control signals for phase and amplitude of speed variations can be derived from direct measurement of strip thickness, or indirect measurement of roll position. Generally, at least one of the casting rolls is supported on mountings which can move laterally of the roll against spring or fluid pressure biasing and it would be feasible to derive control signals by sensing the movement of those mountings or changes in the forces between the rolls. A speed controller operating from oscillations of the casting rolls may be prone to error signals which feed back through the system. On the other hand the strip which leaves the nip hangs in a loop which has the effect of absorbing speed variations so that the strip has essentially constant speed as it passes under the X-ray scanner 44 and the control signals can be developed by a continuous scan to establish a pattern over the whole length of the strip. Typically, this will be a regularly repeating pattern throughout the strip.

It is possible for any strip thickness and casting speed to establish a sensitivity between speed variation and resulting strip thickness variation. Accordingly, the signals derived from X-ray scanner 44 provide a measure of the frequency and amplitude of speed variation cycles which must be imposed to compensate for the measured thickness variations, the amplitude of the imposed speed variations being the amplitude of the measured thickness variations divided by appropriate sensitivity for the particular casting speed and strip thickness.

To achieve appropriate thickness control, the speed variation signals must be applied in proper phase relationship with the rotation of the rolls, ie during each rotation the pattern of speed variation must match the pattern of roll movements caused by the eccentricities. Proper phase matching is achieved by applying the signals at an initial phase relationship with a reference signal producing one pulse per revolution of the rolls and then varying the phase relationship to produce a minimisation of the amplitude of thickness variations. This may be achieved by tracking or plotting an amplitude error signal.

It is found in practice that the phase adjustment of the control signals can be carried out very quickly by visual tracking because the suppression of the amplitude of the thickness variations is very marked when the correct phase matching is achieved. This is demonstrated by FIG. 2 which plots actual results achieved during operation of a strip caster in accordance with the invention. Line 48 plots measurements of thickness variations from the centre-line X-ray scanner through periods of no compensation and periods when control signals are applied at various phase relationships. In this particular case maximum suppression was achieved in the region 49 where the control signals were 180° out of phase with the reference signals. It will be seen in this region that the amplitude of the thickness variations was very significantly reduced compared with the regions where no speed compensation was applied.

In order to provide more accurate compensation for complex thickness variations, it would be possible in a system according to the invention to apply more than one speed variation cycle for each roll rotation. The secondary cycles could be derived by analysis of the signals derived from the X-ray scanner 44. Alternatively, the secondary cycles could be obtained from position or force variation signals derived from the casting roll mountings, since the correlation between the X-ray signals and the roll mountings is already established by phase locking the primary signals.

It is also possible, in a system according to the invention to control the speed of rotation of the casting rolls throughout a cast to compensate for a long term variation or drift in the thickness of the strip throughout the cast. Such long term variation can arise, for example, due to temperature run down in the feed metal heat or melt chemistry variations. A separate control signal can be derived from the continuously varying signals produced by X-ray scanner 44 by employing a different filter to give an average thickness signal which can be used to determine the mean speed of the casting rolls, this signal being fed direct to the roll drive motors to maintain the correct average thickness of the strip throughout the cast.

What is claimed is:

1. A method of casting metal strip comprising introducing molten metal between a pair of chilled casting rolls forming a nip between them to form a casting pool of molten metal supported on the rolls and confined at the ends of the nip by pool confining end closures, rotating the rolls so as to cast a solidified strip delivered downwardly from the nip, transporting the strip away from the nip, inspecting the strip as it is transported away from the nip to determine a pattern of thickness variations along the strip due to eccentricities of the casting roll surfaces, and imposing a pattern of speed variation on the rotation of the casting rolls determined by said pattern of thickness variations so as to reduce the amplitude of the thickness variations.

2. A method as claimed in claim 1, wherein said pattern of thickness variations is a regularly repeating pattern.

3. A method as claimed in claim 2, wherein the strip is inspected by an inspection means which produces signals indicative of the frequency and amplitude of repeating thickness variations and the speed of the casting rolls is varied in accordance with those signals.

4. A method as claimed in claim 2, wherein the pattern of imposed speed variations comprises a single variation for each revolution of the casting rolls.

5. A method as claimed in claim 2, wherein the pattern of imposed speed variations includes more than one variation for each revolution of the casting rolls.

6. A method as claimed in claim 1, wherein the rolls are rotated by electric drive motor means and the pattern of imposed speed variations is imposed by feeding said signals directly to the drive motor means.

7. A method as claimed in claim 2, wherein the imposed speed variation is applied at an initial timing phase relative to the rotation of the rolls and the phase is then varied to minimise the amplitude of the thickness variations.

8. A method as claimed claim 1 which further includes the step of varying the average speed of rotation of the rolls throughout the cast to maintain a constant average thickness of the strip.

9. A method as claimed in claim 3, wherein the rolls are rotated by electric drive motor means and the pattern of imposed speed variations is imposed by feeding said signals directly to the drive motor means at an initial timing phase relative to the rotation of the rolls and the phase is then varied to minimise the amplitude of the thickness variations.

10. A method as claimed in claim 9, which includes the step of varying the average speed of rotation of the rolls throughout the cast to maintain a constant average thickness of the strip.

11. A method as claimed in claim 1, wherein said inspecting of said strip is performed at a location substantially downstream of said nip.

* * * * *